United States Patent [19]

Hultqvist

[11] Patent Number: 4,606,552

[45] Date of Patent: Aug. 19, 1986

[54] LOCK FOR SAFETY BELTS

[75] Inventor: Lars Hultqvist, Västra Frölunda, Sweden

[73] Assignee: Broderna Holmbergs Fabriks AB, Andestorp, Sweden

[21] Appl. No.: 714,633

[22] Filed: Mar. 21, 1985

[30] Foreign Application Priority Data

Mar. 23, 1984 [SE] Sweden ..... 8401617

[51] Int. Cl.[4] ..... B60R 22/00

[52] U.S. Cl. ..... 280/801; 24/573; 24/628; 244/122 B; 297/484

[58] Field of Search ..... 280/801, 808; 297/483, 297/484, 467; 24/573, 574, 604, 628, 633; 244/122 B

[56] References Cited

U.S. PATENT DOCUMENTS

| | | | |
|---|---|---|---|
| 2,275,450 | 3/1942 | Manson | 297/484 |
| 2,312,946 | 3/1943 | Watter | 297/484 |
| 3,633,965 | 1/1972 | Norman et al. | 297/484 |
| 3,834,758 | 9/1974 | Soule | 297/484 |
| 4,302,049 | 11/1981 | Simpson | 280/808 |

*Primary Examiner*—John J. Love
*Assistant Examiner*—Kenneth R. Rice
*Attorney, Agent, or Firm*—Merchant, Gould, Smith, Edell, Welter & Schmidt

[57] ABSTRACT

Lock for safety belts, comprising a lock housing and a lock tongue which can be inserted into the lock housing. The lock tongue is displaceably mounted on a support element and is spring-biased to a withdrawn position, the lock tongue being normally displaceable to a projected position against the spring bias, a latch member engaging the lock tongue in the withdrawn position thereof to prevent displacement of the lock tongue to the projected position. A fitting for a strap can be passed onto the lock tongue in the withdrawn position thereof, said fitting engaging the latch member to release the lock tongue for displacement to the projected position against the spring bias.

7 Claims, 5 Drawing Figures

LOCK FOR SAFETY BELTS

Figure 1:
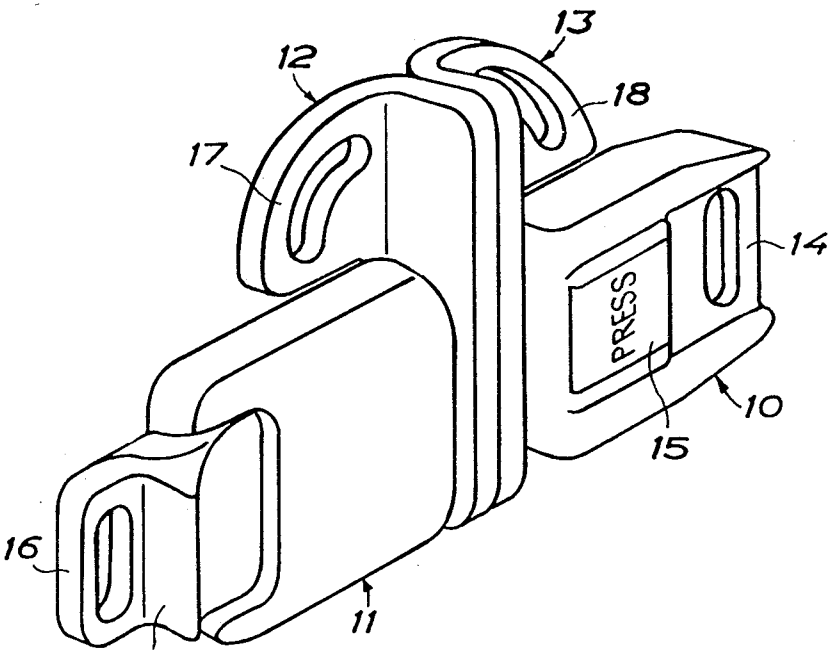

The invention relates to a lock for safety belts having at least two hip strap portions and at least one further strap portion.

When safety belts of this type are used as vehicle belts for children the safety belt comprises, in addition to the two hip strap portions attached one at each side of the seat, also two shoulder strap portions which are attached behind the seat, and possibly also a fifth strap portion which is attached below in front of the seat and is extended upwards between the legs of the user. The invention relates particularly to vehicle safety belts of this type with or without said fifth strap portion.

A safety belt having five strap portions is shown and described in the French patent specification 2,116,541. In that case, all strap portions are provided with lock tongues which can be inserted into a lock housing including a lock mechanism for co-operation with the lock tongues. Externally of the lock housing, there is provided a release member for manual operation which can be operated stepwise in order to release the lock tongues of the shoulder straps and to release the lock tongue of one hip strap portion and the lock tongue of the strap portion extended upwards between the legs.

It has been noticed that one lock tongue or the other of such a lock can be inserted into the lock housing without being lockingly engaged by the lock mechanism. If this is the case, the vehicle belt does not, of course, provide the intended protection for the user, and in fact there may be involved a risk of serious injuries to the user if an accident should occur when one lock tongue or the other is not engaged. In order to eliminate this risk the authorities concerned in some countries have decreed that it should be indicated, when the vehicle belt is put into use, that all lock tongues are engaged with the lock mechanism.

The German utility model registration No. G 82 30 071.2 shows and describes a belt lock which satisfies said requirements. The lock is arranged such that the lock housing is attached to one hip strap portion and that a lock tongue is attached to the other hip strap portion for co-operation with the lock housing. The two shoulder strap portions are provided with fittings which are passed onto projections on the lock housing and/or the lock tongue and are retained on these projections by the lock housing and the lock tongue being lockingly engaged. Thus, it is possible to see directly from the outside if the two shoulder strap portions are connected when the lock tongue and the lock housing are engaged. However, this prior art lock has the drawback that it may be rather cumbersome to connect the shoulder strap portions, since it is necessary to pass said portions manually onto the projection or projections and to retain them there while the lock housing and the lock tongue are being lockingly engaged.

It is the purpose of the invention to provide a lock of a construction which is not too complicated and which satisfies the safety requirements now applied and at the same time can be easily handled when used.

For this purpose and other purposes which will be apparent from the description which follows, the invention provides a lock for safety belts having two hip strap portions and at least one further strap portion, comprising a lock housing to be attached to one hip strap portion, a lock mechanism having a release member for manual operation, said lock mechanism being enclosed by said lock housing, a lock tongue to be attached to the other hip strap portion, which can be inserted into the lock housing for co-operation with the lock mechanism, a support element displaceably mounting said lock tongue, spring means biasing the lock tongue to a withdrawn position, the lock tongue being manually displaceable to a projected position against the spring bias, a latch member engaging the lock tongue in the withdrawn position thereof to prevent displacement of the lock tongue to the projected position, and at least one fitting for said further strap portion to be passed onto the lock tongue in the withdrawn position thereof, said fitting engaging the latch member to release the lock tongue for displacement to the projected position under the spring bias.

Figure 2:
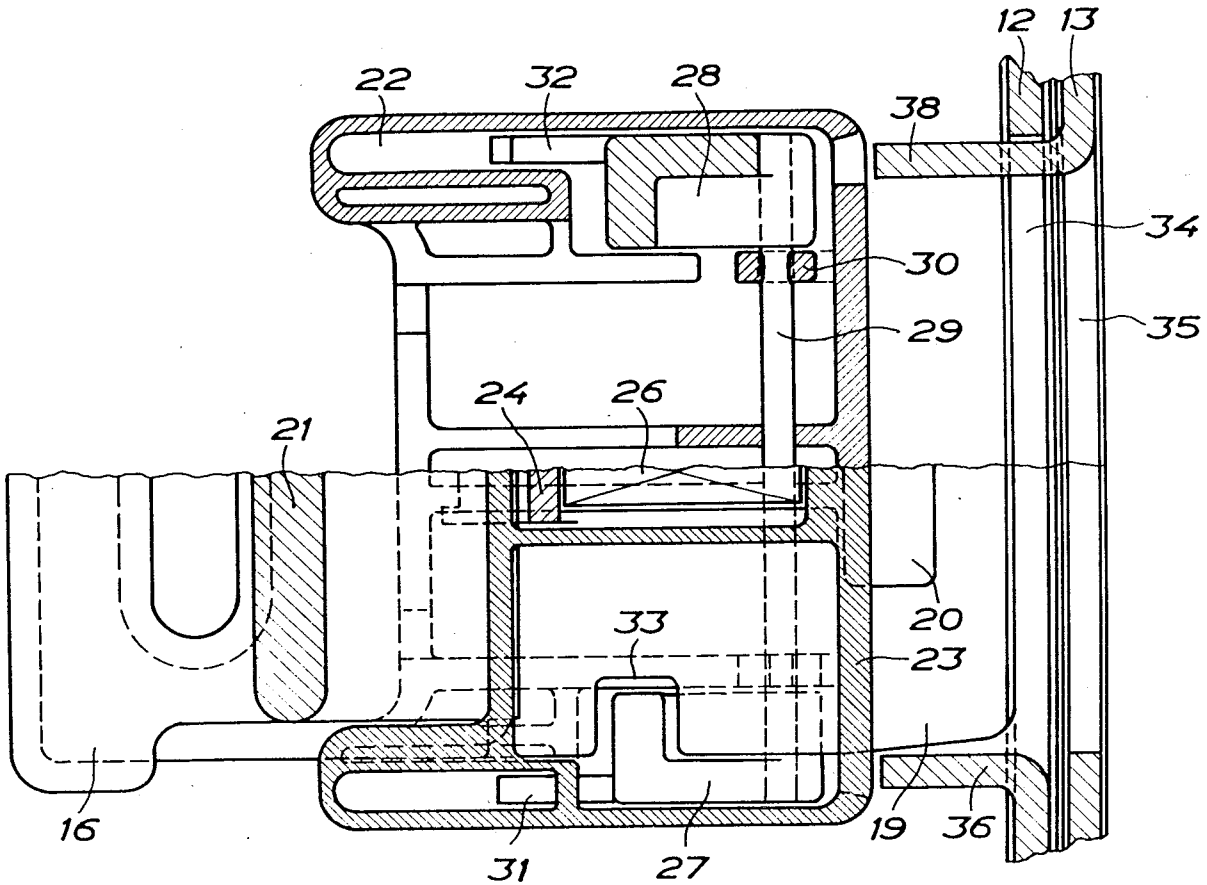
Figure 3:
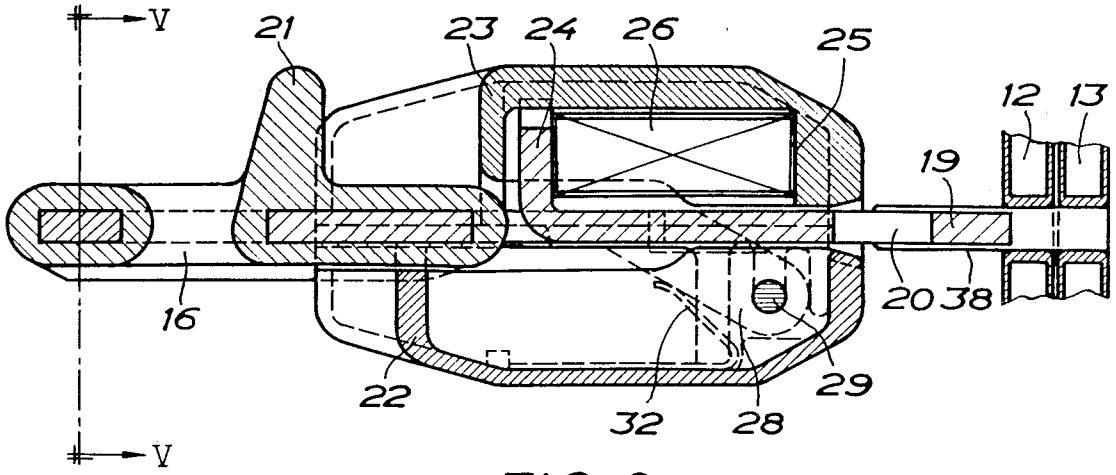
Figure 4:
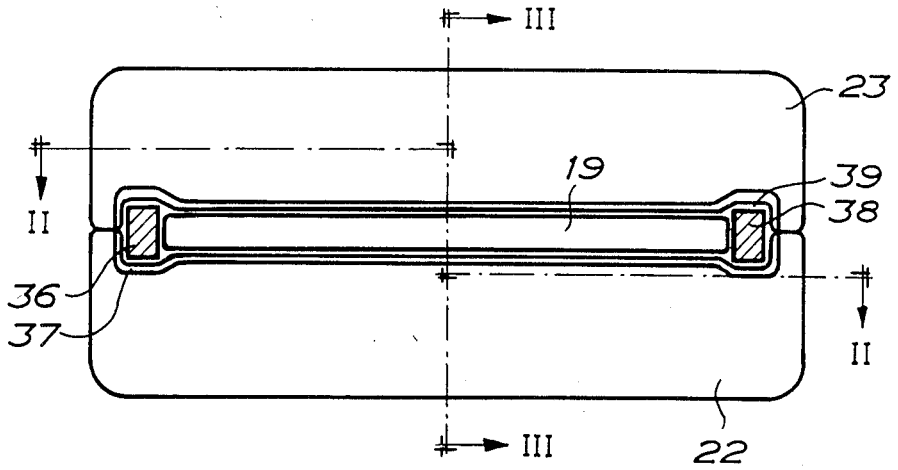
Figure 5:
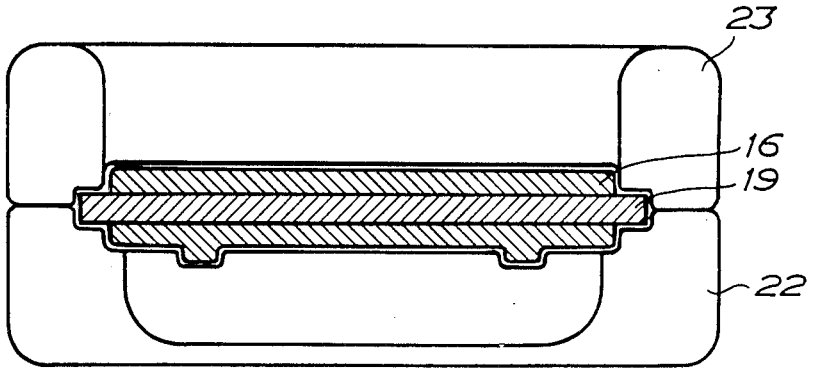

In order to explain the invention more clearly an embodiment thereof will be described in detail below, reference being made to the accompanying drawings in which FIG. 1 is a perspective view of the lock of the invention, FIG. 2 is a sectional view of the lock tongue element and fittings co-operating therewith, taken along line II—II in FIG. 4, FIG. 3 is a longitudinal sectional view of the lock tongue element and the fittings, taken along line III—III in FIG. 4, FIG. 4 is an end view from the right as seen in FIG. 3, projections on the fittings being shown in cross section, and FIG. 5 is a cross-sectional view along line V—V in FIG. 3.

Referring to FIG. 1, the lock of the invention, which in the embodiment shown is intended for a safety belt with a hip strap and two shoulder straps of the type used as a vehicle belt for children, comprises a lock housing element 10 and a lock tongue element 11 as well as two shoulder strap fittings 12 and 13. The lock housing element 10 is provided with an attachment 14 for one hip strap portion and includes a lock mechanism which can be of any conventional embodiment for co-operation with a lock tongue. The lock mechanism can be operated by means of a push button 15 for releasing the lock tongue element from the lock housing element. The lock tongue element 11 comprises an attachment 16 for the other hip strap portion, and the two fittings 12 and 13 comprise an attachment 17 and 18, respectively, for the associated shoulder strap portion. The lock housing element 10 will not be described in more detail, because said element, as mentioned above, can be of any conventional embodiment.

Referring now to FIGS. 2 to 5, the lock tongue is designated 19 and forms an aperture 20 for engagement with a lock member in the look mechanism of the lock housing element 10. The lock tongue comprises a punched steel plate having a moulding of plastic material in the region of the attachment 16. This moulding forms a projecting push button 21 as is shown also in FIG. 1.

The lock tongue 21 is mounted in a casing preferably made of injection-moulded plastic material, which comprises a rear half 22 and a front half 23 interconnected in a suitable conventional manner. The lock tongue is guided in the casing for displacement in the longitudinal direction thereof. A lug 24 is bent up from the lock tongue, and between this lug and a support surface 25 formed by the housing half 23 a helical compression spring 26 is engaged which accordingly biases the lock tongue to the left as seen in FIGS. 2 and 3. The lock tongue is kept in contact with a suitable abutment in the housing which defines the position shown which is a withdrawn position. In this position, the lock tongue does not project sufficiently from the casing 22, 23 to be engaged with the lock mechanism in the lock housing element 10. In order to effect such engagement the lock tongue must be pushed forwards to a projected position against the bias of the spring 26, but normally this is prevented by a latch mechanism.

Said latch mechanism comprises two angular latches 27 and 28 pivotally mounted at the ends of a shaft 29 attached to the housing half 22 by means of attachments 30. Each latch is biased by means of a leaf spring 31 and 32, respectively, to the position shown in FIGS. 2 and 3, in which the latch is received by an associated recess 33 in the lock tongue 19. In this position, each latch prevents displacement of the lock tongue 19 against the bias of the spring 26 to the projected position.

The shoulder strap fitting 12 forms a slot 34 to be passed onto the lock tongue 19, and the shoulder strap fitting 13 forms a corresponding slot 35. The shoulder strap 12 also forms a projection 36 which can be inserted into the casing 22, 23 of the lock tongue element 11 through an opening 37 in the end wall of the casing, and a corresponding projection 38 is provided on the shoulder strap fitting 13 to be inserted through an opening 39 in the end wall of the casing. Then, the projection 38 must be inserted through the slot 34 in the shoulder strap fitting 12 and accordingly this slot must be sufficiently larger than the lock tongue 19 to make room also for the projection 38. When the projections 36 and 38 are being inserted into the casing of the lock tongue element, they will engage the latch 27 and the latch 28, respectively, which are cammed away against the bias of the spring 31 and the spring 32, respectively, so as to be disengaged from the recess 33 in the lock tongue 19.

Thus, when the lock is to be used, the two shoulder strap fittings 12 and 13 are put together with the flat sides contacting each other as shown in FIGS. 1 to 3, the projection 38 being passed through the slot 34 in the shoulder strap fitting 12, and are passed onto the lock tongue 19 in the withdrawn position thereof, the projections 36 and 38 being inserted into the casing 22, 23 of the lock tongue element through the openings 37 and 39. Not until the shoulder strap fitting 12 is very closely engaging the casing of the lock tongue housing, the projections 36 and 38 have cammed away the latches 27 and 28 against the bias of the springs 31 and 32 to such extent that the latches have completely disengaged the recesses 33. The lock tongue 19 is now released and it can be displaced manually at the push button 21 to the projected position against the bias of the spring 21, and in this position, the lock tongue with the two shoulder strap fittings engaged therewith project sufficiently from the casing of the lock tongue element to be inserted into the lock housing element and be engaged with the lock mechanism therein. The condition of FIG. 1 is obtained with the two shoulder strap fittings 12 and 13 safely attached to the lock tongue between the lock housing element 10 and the lock tongue element 11. When the lock tongue has been engaged with the lock mechanism, which is indicated by a clearly noticed click in the lock mechanism, it is possible to visually recognize that also the two shoulder strap portions are safely connected to the lock.

When the lock tongue element 11 is released from the lock housing element 10 by operation of the release member 15, the lock tongue 19 will be withdrawn by the spring 26 to the withdrawn position and the latches 27 and 28 will return to engagement with the lock tongue and thus the two shoulder strap fittings can be removed freely from the lock tongue.

I claim:

1. Lock for safety belts having two hip strap portions and at least one further strap portion, comprising a lock housing to be attached to one hip strap portion, a lock mechanism having a release member for manual operation, said lock mechanism being enclosed by said lock housing, a lock tongue to be attached to the other hip strap portion, which can be inserted into the lock housing for co-operation with the lock mechanism, a support element displaceably mounting said lock tongue, spring means biasing the lock tongue to a withdrawn position, the lock tongue being manually displaceable to a projected position against the spring bias, a latch member engaging the lock tongue in the withdrawn position thereof to prevent displacement of the lock tongue to the projected position, and at least one fitting for said further strap portion to be passed onto the lock tongue in the withdrawn position thereof, said fitting engaging the latch member to release the lock tongue for displacement to the projected position against the spring bias.

2. Lock as claimed in claim 1 wherein the support element forms a casing receiving the lock tongue.

3. Lock as claimed in claim 2, further comprising a projection on the fitting to be inserted into the casing for engagement with the latch member.

4. Lock as claimed in claim 2 wherein two fittings for two shoulder strap portions are provided and wherein a projection is provided on each fitting to be inserted into the casing for engagement each with one latch member.

5. Lock as claimed in claim 4 wherein the projection of one fitting is insertable through an aperture formed by the other fitting.

6. Lock as claimed in claim 3 wherein the projection is dimensioned to operate the latch member to disengaged position when the fitting is slightly spaced from the casing.

7. Lock as claimed in claim 1 wherein the latch member comprises a pivotable latch and spring means biasing said latch to the engaged position.

* * * * *